United States Patent [19]

Niman

[11] Patent Number: 4,970,522

[45] Date of Patent: Nov. 13, 1990

[54] WAVEGUIDE APPARATUS

[75] Inventor: Murray J. Niman, Chelmsford, United Kingdom

[73] Assignee: Marconi Electronic Devices Limited, Middlesex, United Kingdom

[21] Appl. No.: 392,289

[22] Filed: Aug. 11, 1989

[30] Foreign Application Priority Data

Aug. 31, 1988 [GB] United Kingdom ..... 8820556

[51] Int. Cl.[5] ..... H01Q 3/28; H01Q 3/34; H01Q 13/10; H01P 5/00

[52] U.S. Cl. ..... 342/374; 333/237; 333/248; 343/771

[58] Field of Search ..... 333/237, 248, 250; 342/374, 375; 343/776, 777, 771

[56] References Cited

U.S. PATENT DOCUMENTS 3,219,747 11/1965 McAdams ..... 333/248 X
3,825,863 7/1974 Meier ..... 333/248 X

FOREIGN PATENT DOCUMENTS 3019523 11/1981 Fed. Rep. of Germany ..... 333/250
2207009 1/1989 United Kingdom .

*Primary Examiner*—Paul Gensler
*Attorney, Agent, or Firm*—Spencer & Frank

[57] ABSTRACT

Waveguide apparatus in which a dielectric substrate is placed between sections of a waveguide. The dielectric substrate incorporates slots arranged in a linear fashion and having extended portions, there being a narrow gap between adjacent slots. This enables accurate control of radiation losses through the dielectric layer sandwiched between the sections of the waveguide to be achieved.

29 Claims, 6 Drawing Sheets

WAVEGUIDE APPARATUS

BACKGROUND OF THE INVENTION

This invention relates to waveguide apparatus and in particular, but not exclusively, to apparatus comprising a waveguide consisting of two or more sections.

With the advent of modern transceiver/receiver technology, often operating at millimeter wavelengths, it is sometimes necessary to use what is commonly referred to as E-plane technology.

E-plane technology refers to the technique of mounting devices in the E-plane or electric field plane of the dominant mode of the waveguide. This plane usually extends along the waveguide perpendicular to the broadwall of the waveguide at the position where the radio frequency current is a minimum, normally in the plane bisecting the broadwall.

In a known configuration, when using the above technology, components are mounted on a dielectric substrate as shown in FIG. 1 of the accompanying drawings, where the dielectric 1 is held in position by being sandwiched between the mating surfaces 2 of sections 3 and 4 which comprise the waveguide.

Unfortunately, by inserting the substrate between the sections of the waveguide there is a discontinuity of the metallic inner wall of the waveguide at the dielectric. This results in power losses from the guide through the substrate layer and is detrimental to the performance of the waveguide.

In order to reduce losses through the substrate layer the apparatus shown in FIG. 2 of the accompanying drawings has been proposed. The dielectric substrate 5, normally in the form of a PCB, is located in detents 6 in the waveguide 7. As the substrate does not extend across the whole width of the waveguide walls there is thus a continuous inner metallic wall and therefore no escape path for the signal being propagated along the waveguide. However, this technique requires precise machining of the guide and substrate and leads to problems in connecting components carried by the substrate to apparatus outside the waveguide.

An alternative apparatus is shown in FIG. 3. The dielectric substrate 8 may have components mounted on it, prior to assembly, which can be connected via conductors carried by the substrate to the external wall 9. Construction tolerances are not so critical, as the substrate is simply sandwiched between the sections 10 and 11 of the waveguide, and can therefore be produced more cheaply than the apparatus shown in FIG. 2. To reduce the losses from the waveguide cavity 12 via the dielectric substrate 8, the substrate extends into secondary cavities 13 and 14 on either side of the waveguide. These behave as radio frequency chokes limiting power losses from the central cavity 12. However, there may still be an appreciable power loss from the waveguide and the bulk of the structure is considerably increased.

British patent application GB No. 2 207 009, published Jan. 18th, 1989, describes apparatus as shown in FIGS. 4A, 4B and 4C, for reducing the above-mentioned power losses without increasing the bulk of the waveguide.

Slots 15 are incorporated within the dielectric 17 separated by gaps d as shown in FIG. 4A. These slots 15 are through-plated so as to have a conductive layer 16 on their inner surfaces. When the substrate is assembled between two sections of the waveguide 18 and 19 as shown in FIG. 4B, and FIG. 4C. (which is a transverse cross-sectional view of the waveguide), the inner conductive surfaces 16 of the slots 15 bridge the gap between the sections 18 and 19. This effectively continues the metallic wall of the waveguide across the dielectric region 17, except in the regions of the gaps between adjacent slots, d, which still permit some power loss from the guide.

The object of the present invention is to control further these power losses.

BRIEF SUMMARY OF THE INVENTION

According to the present invention, there is provided a waveguide apparatus comprising a waveguide having partly sandwiched in one or more walls of the waveguide a dielectric substrate incorporating a plurality of slots, each slot comprising a first elongate portion with second and third elongate portions respectively extending to one side from both ends of the first elongate portion each slot having a conductive layer upon at least part of its inner surface, and substantially the same orientation as those adjacent to it. Further, first portions of adjacent slots are substantially co-linear, and at least part of the conductive surface of the slots is so positioned as to form part of the inner surface of the waveguide.

The dielectric substrate, when suitably located, enables E-plane technology to be employed and permits components to be mounted on the dielectric prior to assembly. The conductive coatings on the inner surfaces of the slots effectively form a continuation of the inner metallic wall across the thickness of the dielectric, parallel to the wall of the waveguide which the dielectric intersects, and controls the power losses. The power losses through the regions between the slots, where there is no conductive material, are controlled by the second and third elongate portions of the slots, which can be arranged so that the region between adjacent slots function as waveguides.

By configuring the slots so that they include said second and third portions, the coupling factor can be controlled. This is a measure of the ratio of coupling between the field within the waveguide cavity and that outside the waveguide, and is dependent upon: the width of the gap between the second portion of each slot and the third portion of the adjacent slot: the angle between these second and third portions; the length of said second and third portions; the thickness of the substrate and the value of the dielectric constant of the substrate material. It is therefore possible, by selecting suitable dimensions and configurations of the slots, to control the coupling factor and accurately control power losses through the gaps.

If attenuation of the waveguide is to be optimized it is preferable to have waveguide apparatus wherein the slots are arranged so as to minimize power losses from the waveguide. This can be achieved by having waveguide apparatus in which the slots are arranged such that the second and third portions are extending perpendicular to the longitudinal axis of the waveguide, the adjacent slots being arranged with a relatively small spacing between them and having relatively long second and third portions. Arranging the apparatus in this manner, providing long narrow gaps between the slots perpendicular to the waveguide, causes high attenuation in these areas by acting as a waveguide with a cut-off frequency below that of the wave being propagated along &he main waveguide cavity. This greatly reduces losses, whilst still providing an electrically non-conductive structure for supporting components within the waveguide which is of sufficient strength for assembly purposes and which is physically robust.

In another alternative embodiment, it may be beneficial to have waveguide apparatus in which the configuration of slots is arranged such that the waveguide apparatus functions as an antenna, that is,.in which, rather than reducing losses, it is arranged so that radiation escapes from the waveguide in a controlled fashion. Preferably, the second and third portions of the adjacent slots are arranged non-parallel to each other and have a minimum separation at their ends adjoining the first portions. The arrangement of the slots in this manner enables accurate control of power losses through each gap, and angling said second and third portions enables each gap to effectively act as a two-dimensional horned antenna. However, it is possible to use slots with parallel adjacent second and third portions as a phased array antenna by choosing a large enough gap between adjacent slots. As the positioning and dimensions of the slots may be accurately achieved, for example, by stamping, use of the invention enables millimetric wave array antennas to be fabricated more cheaply and easily than has previously been possible. At present, most production techniques for producing such antennas involve expensive CNC machining of slots in a waveguide body, but at millimetric wavelengths it is difficult to achieve the required tolerances which may make prediction of radiation levels difficult.

Advantageously, where the apparatus in accordance with the invention is arranged to act as an antenna, an electrical component is arranged to connect conductive layers extending from facing walls of the waveguide, enabling modification of a signal transmitted along the waveguide to be achieved. Advantageously, a plurality of said components are included to control the phase and/or amplitude of a signal as it is transmitted along the waveguide. The waveguide may thus be arranged to act as an active phased array antenna.

Construction of a phased array antenna in the above manner offers considerable advantages over conventional construction techniques already described and enables appropriate components to be sub-assembled upon the substrate prior to assembly within the waveguide itself, providing a very efficient way of manufacturing compact steerable phased array antennas. In some applications it may be a further advantage if several such waveguides are cascaded together to form a rectangular array antenna. This may be achieved by applying a signal in parallel to a plurality of waveguides which are physically located adjacent to one another and the phase of the signal applied to each guide may be controlled such that the rectangular array is steerable.

Brief Description of the Drawings

Some ways in which the invention may be performed are now described by way of example only, with reference to the drawings, in which.

Detailed Description of the Preferred Embodiments

Figure 1:
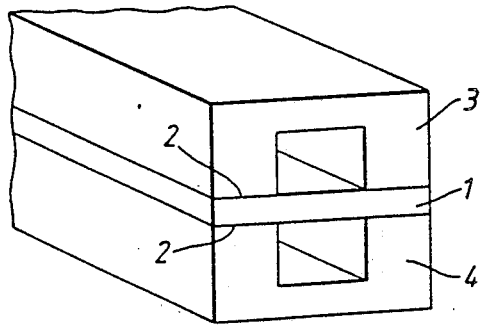
FIG. 1. (PRIOR ART)
FIGS. 1, 2, 3, 4A, 4B and 4C, previously referred to, show examples of known waveguide configurations.
Figure 2:
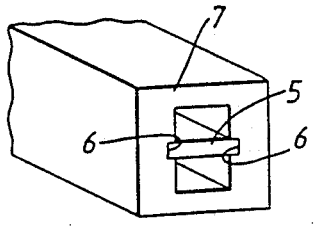
FIG. 2. (PRIOR ART)
Figure 3:
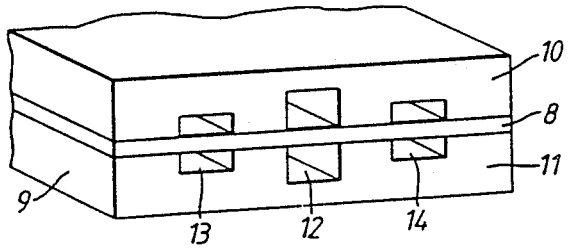
FIG. 3. (PRIOR ART)
Figure 4A:
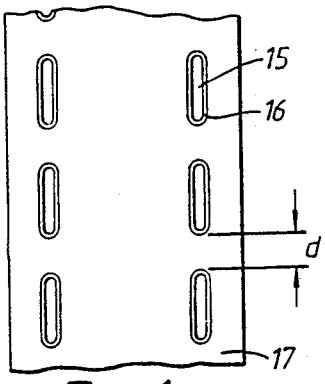
Figure 4B:
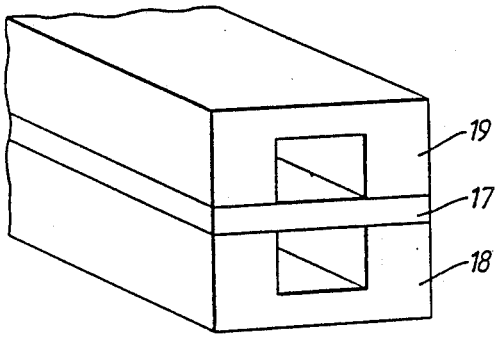
Figure 4C:
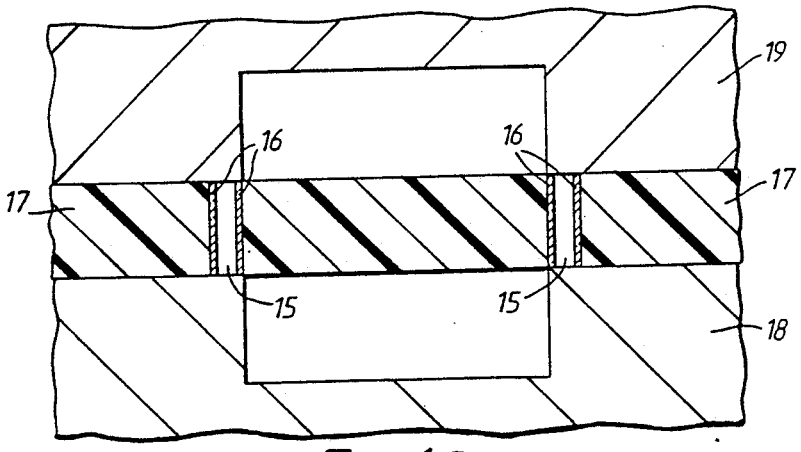
Figure 5A:
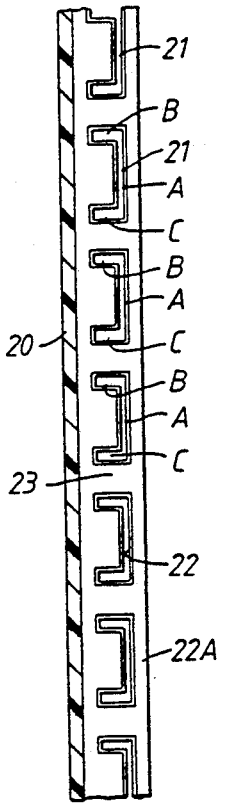
FIGS. 5A, 6A and 7A are plan views of dielectric substrates, which are part of respective different waveguide apparatus in accordance with the invention.
Figure 5B:
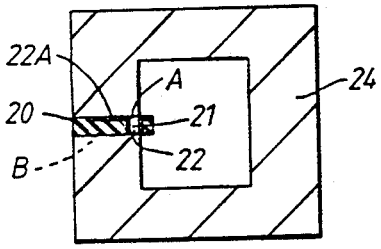
FIGS. 5B, 6B and 7B are transverse sections of waveguides in accordance with the invention incorporating the dielectric substrates of FIGS. 5A, 6A and 7A respectively.

With reference to FIG. 5A, a dielectric substrate 20, for use in waveguide apparatus and shown shaded for reasons of clarity, has slots 21 in it. Each slot has three portions A, B and C, which correspond to first, second and third portions respectively. The slots 21 are linearly arranged with the first portions A of adjacent slots being substantially co-linear. The second and third .portions B and C of each slot are arranged at right angles to the first portion A. Each slot has a metallized inner surface 22 which is continuous with a metallic area 22A on one of the surfaces of the dielectric substrate 20. This substrate 20 is shown assembled within a waveguide 24 in FIG. 5B, the metallized area 22A being extending within the waveguide to form a fin-line waveguide. This illustrated arrangement has lower power losses than a conventional fin-line waveguide because the portions B and C of the slots extend from portion A in a direction away from the central cavity of the waveguide 24. The metallized coating 22 of the end portions B and C causes the gaps 23 between adjacent slots to function as waveguides, the dimensions being such that the cut-off frequency of the gap is less than that of the signal being propagated, causing attenuation of the wave in the gaps 23 and thereby reducing losses from the waveguide 24 itself. Broken lines indicate the location of different parts of the substrate 20 illustrated in FIG. 5A when it is positioned in the waveguide 24.

Figure 6A:
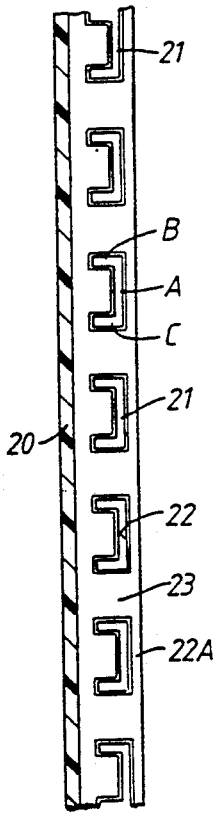
Figure 6B:
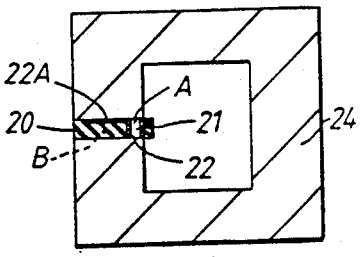

In another waveguide apparatus in accordance with the invention as shown in FIG. 6A, adjacent slots 21 in a dielectric substrate 20 are more widely spaced than those in the substrate of FIG. 5A, enabling the regions 23 between slots to act as propagation paths for the signal. Thus the waveguide apparatus in FIG. 6B which incorporates the substrate 20 of FIGS. 6A, functions as a phased array antenna. The size of the gap between the slots 21 is determined empirically.

Figure 7A:
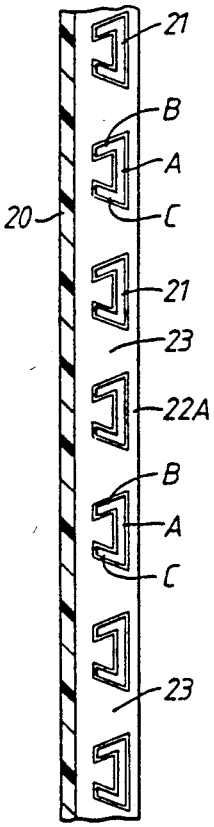

With reference to FIG. 7A which schematically illustrates another substrate 20, the portions B and C of adjacent slots 21 are non-parallel such that the gaps 23 between slots 21 act as miniature two-dimensional waveguide horns.

Figure 7B:
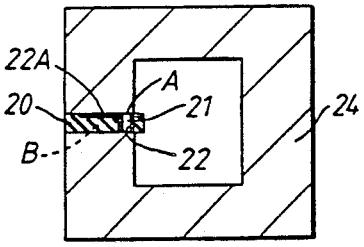

When the substrate 20 is incorporated in the waveguide 24, as shown in FIG. 7B, the waveguide apparatus functions as a horned phased array antenna, permitting energy to be radiated through the gaps 23 between the slots 21.

Figure 8A:
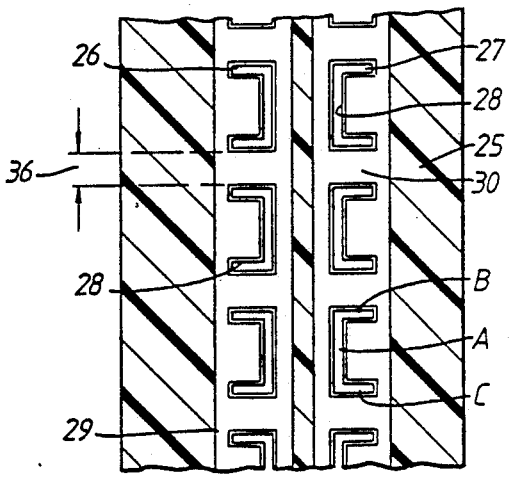
FIG. 8A is a plan view of another substrate, part of waveguide apparatus in accordance with the invention, for reducing resonance losses from a fin-line waveguide.
Figure 8B:
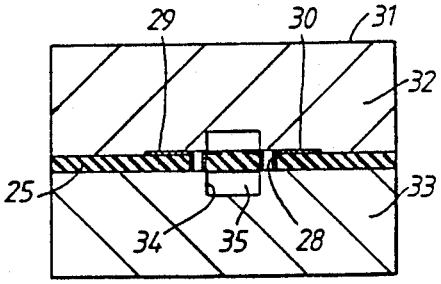
FIG. 8B shows a cross-sectional view of a fin-line waveguide incorporating the substrate of FIG. 8A.

With reference to FIG. 8A, another dielectric substrate 25 is shown, which includes two parallel rows 26 and 27 of slots. Each slot is similar to those illustrated in FIG. 5A, and the two rows 26 and 27 are arranged so that the second and third portions B and C of one row of slots extend from the corresponding first portions A in the opposite direction to those of the other row. Each slot is covered with a metallic layer 28 on its inner surface. There are also two metallized areas 29 and 30 which surround the slots of the upper surface as shown of the dielectric substrate 25. FIG. 8B shows the substrate 25 of FIG. 8A located within a waveguide 31 which is formed from two sections 32 and 33. The metallized coating 28 on the slot surfaces effectively extends the waveguide inner wall 34 across the boundary between the two sections 32 and 33. The portions B and C of the slots function as described with reference to FIGS. 5A and 5B. The portions B and C of the slots in both rows 26 and 27 extend from portion A in a direction away from the central cavity 35 of the waveguide 31. The metallized coating 28 of the end portion B and C causes the gaps 36 between adjacent slots to function as waveguides, the dimensions being such that the cut-off frequency of the gap is less than that of the signal being propagated causing attenuation of the wave in the gaps 36 and thereby reducing losses from the waveguide 31 itself. The metallized areas 29 and 30 extend within the central cavity 35 of the waveguide 31, and function as a fin-line waveguide.

Figure 9:
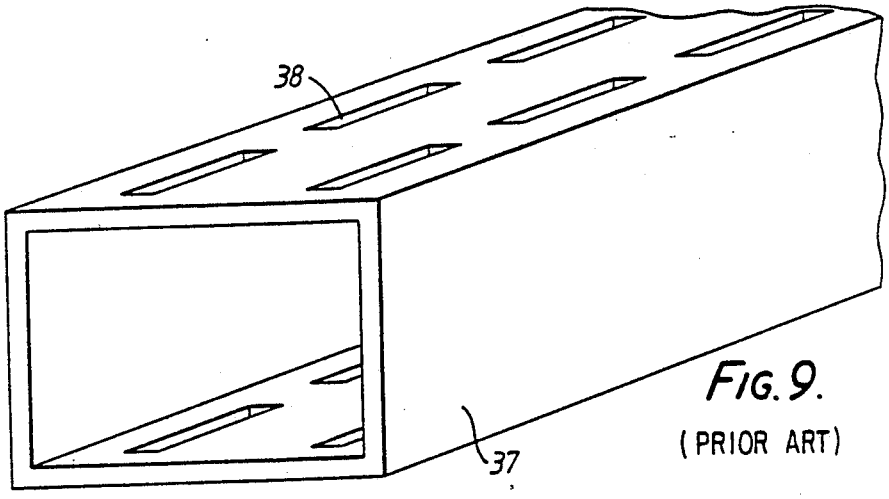
FIG. 9. (PRIOR ART)
FIG. 9 is a diagrammatic representation of a known type of slotted waveguide array antenna.
Figure 10A:
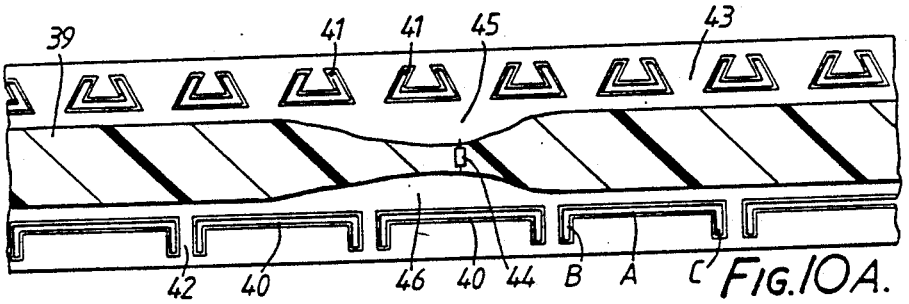
FIG. 10A is a plan view of a substrate, part of waveguide apparatus in accordance with the invention, suitable for incorporation into a waveguide such as to form a phased array antenna.
Figure 10B:
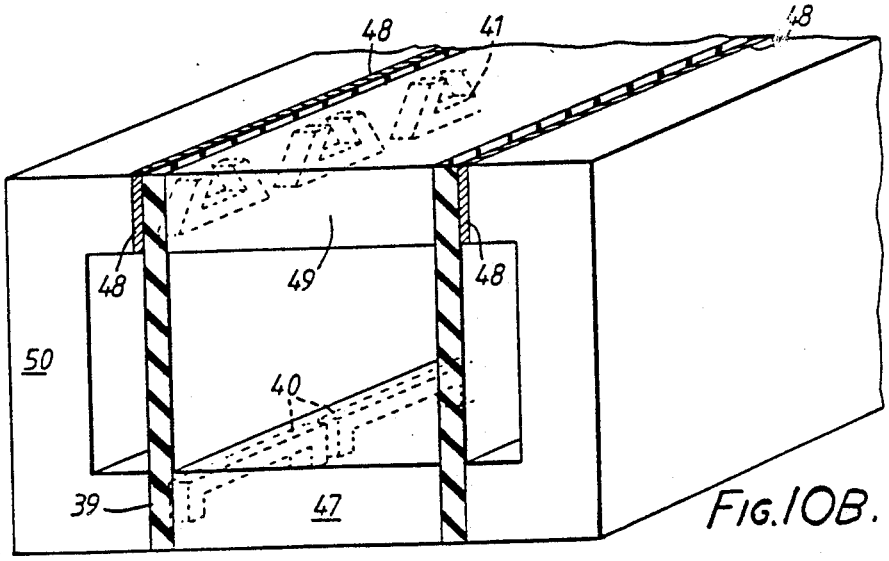
FIG. 10B is a diagrammatic representation of a waveguide produced in accordance with the invention and incorporating the substrate of FIG. 10A.

In another embodiment of this invention, the waveguide apparatus is arranged to act as a phased array antenna. FIG. 9 schematically shows a conventional slotted array antenna. It comprises a waveguide 37 having slots 38 machined in it, these slots usually being produced by expensive CNC machining techniques which are not capable of producing the tolerances required for millimetric systems, as are possible using the present invention. FIGS. 10A and 10B schematically show a phased array antenna in accordance with the present invention. FIG. 10A illustrates in plan view a dielectric substrate 39 having two rows 40 and 41 of slots through it. The lower row 40, as illustrated, is designed to reduce losses from the waveguide to a minimum, the first portion A of the slots being as long as practicable and the gaps 42 between adjacent slots the minimum possible whilst ensuring that the substrate 39 is physically robust enough for assembly purposes and to withstand physical shocks it is likely to receive in service. The narrow gaps 42 between the slots allow very little radiation to escape from the waveguide.

The slots of the upper row 41, as shown, are arranged to have a substantially wider gap 43 between adjacent slots. The second and third portions are angled with respect to the first portions so as to form what are effectively two-dimensional antenna horns between adjacent slots. This enables radiation to escape from the waveguide in a controlled manner.

A component 44 is mounted between two conductive areas 45 and 46 surrounding the slots, and may be a PIN diode or other such device to enable the phase and/or amplitude of a signal travelling along the guide to be modified. Although only one component is shown, in practical applications there would be many such components. When the substrate 39 is assembled in the waveguide 47 as shown in FIG. 10B, where two such substrates have been incorporated, one row 40 of slots limits radiation from the bottom section of the waveguide 47 whilst the other row 41 of slots permits radiation to escape from the waveguide through its upper face. The component 44, (not shown in FIG. 10B) is used to control the phase and/or amplitude of the signal in the waveguide, enabling the waveguide apparatus to act as a steerable phased array antenna. Insulating layers 48, shown in FIG. 10B, enable a potential difference to be applied between two regions 49 and 50 of the waveguide 47 thereby providing a potential difference between the metallized areas 45 and 46 of FIG. 8A. This provides a potential difference across component 44 and therefore a means of controlling the component.

Figure 11A:
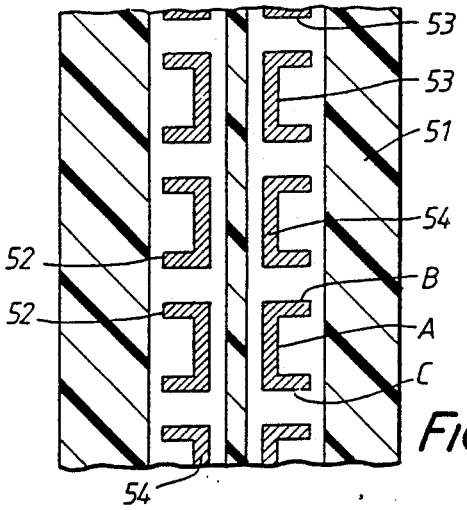
FIGS. 11A and 11B illustrate schematically another apparatus in accordance with the invention and FIGS. 12 is a diagrammatic representation of a rectangular array antenna in accordance with the invention.
Figure 11B:
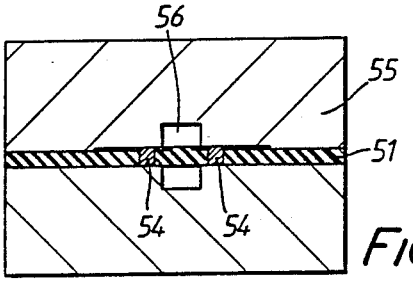

With reference to FIG. 11A in another embodiment of the invention, a dielectric substrate 51 includes two rows 52 and 53 of slots arranged to reduce power losses from a waveguide. Each slot is filled with conductive material 54, which, when the substrate 51 is located in a waveguide 55, forms part of the inner surface of the waveguide wall, as shown in FIG. 11B. In this embodiment the slots are set back from the waveguide cavity 56 so that the effective inner surface of the waveguide is indented. One advantage of having the slots completely filled with conductive material is that it ensures that there are no discontinuities in the metallic surface around the edge of the slot.

Figure 12:
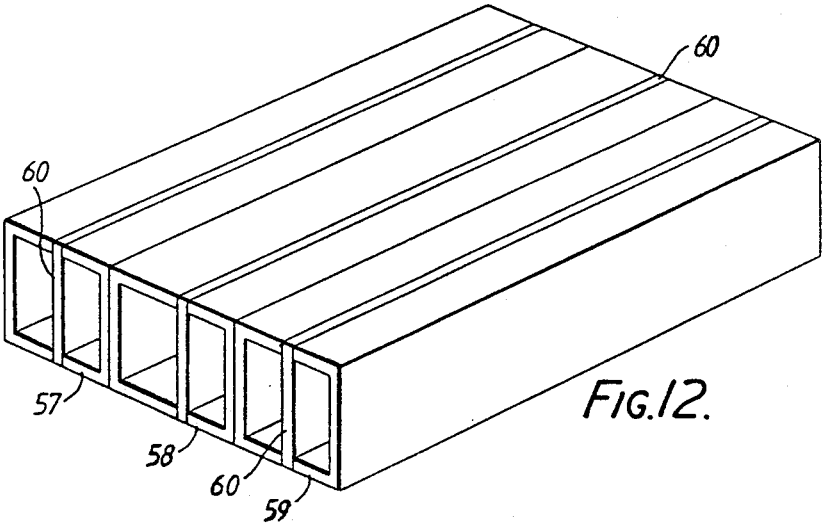

FIG. 12 shows a rectangular array antenna consisting of sections of waveguide apparatus 57, 58 and 59, each of which is similar to the waveguide apparatus shown in FIG. 10B, but having only a single dielectric layer 60.

The input signal to all the guides may be applied to them in parallel, and the phase of the waves in each section may be controlled such that a steerable array may be produced.

I claim:

1. Waveguide apparatus comprising a waveguide having at least one wall with an inner surface defining a cavity, a longitudinal axis and a dielectric substrate partly sandwiched in at least one wall of the waveguide, the dielectric substrate having at least one row of a plurality of adjacent slots; each slot comprising a first elongate portion, second and third elongate portions extending to one side from respective ends of the first elongate portion; and a conductive layer upon at least part of its surface forming the slots, wherein each slot is of substantially the same orientation as slots adjacent to it, first portions of adjacent slots are substantially co-linear, and at least part of the conductive layer of the dielectric substrate is positioned to form part of the inner surface of the waveguide.

2. Waveguide apparatus as claimed in claim 1 wherein each slot is filled with a conductive material.

3. Waveguide apparatus as claimed in claim 1, wherein the waveguide comprises two sections of at least one wall, each section having planar mating surfaces and wherein the dielectric substrate is sandwiched between these surfaces.

4. Waveguide apparatus as claimed in claim 1, wherein the conductive layer extends over part of a surface of the dielectric substrate.

5. Waveguide apparatus as claimed in claim 1, wherein the dielectric substrate is arranged in the waveguide such that the first elongate portions of the slots are substantially parallel to the longitudinal axis of the waveguide and the second and third portions extend away from the center of the waveguide.

6. Waveguide apparatus as claimed in claim 5 wherein the slots are arranged so as to minimize power losses from the waveguide.

7. Waveguide apparatus as claimed in claim 6, wherein the slots are arranged such that the second and third portions extend perpendicular to the longitudinal axis of the waveguide, the adjacent slots being arranged with a relatively long second and third portions.

8. Waveguide apparatus as claimed in claim 1 wherein the configuration of the slots is such that the waveguide apparatus is operative as an antenna.

9. Waveguide apparatus as claimed in claim 8, wherein the second and third portions of the adjacent slots are non-parallel to each other and have a minimum separation at their ends adjoining the first portions.

10. Waveguide apparatus as claimed in claim 1, further comprising a second dielectric substrate and wherein the dielectric substrates are arranged to extend from facing walls of the waveguide, being co-planar with one another and having a gap between them.

11. Waveguide apparatus as claimed in claim 10, wherein the conductive layer extends over part of the surface of the dielectric substrate surrounding a slot and extends from a waveguide wall into the waveguide cavity.

12. Waveguide apparatus as claimed in claim 11, further comprising an electrical component arranged to connect conductive layers extending from facing walls of the waveguide.

13. Waveguide apparatus as claimed in claim 12, wherein a plurality of said components control the phase of a signal as it is transmitted along the waveguide, and the waveguide is operative as an active phased array antenna.

14. Waveguide apparatus as claimed in claim 13 wherein several such waveguides are arranged to form a rectangular array antenna.

15. Waveguide apparatus as claimed in claim 14 and including means for applying a signal to the waveguide in parallel.

16. Waveguide apparatus as claimed in claim 1, further comprising insulating material disposed between the dielectric substrate and an adjacent part of a waveguide wall.

17. Waveguide apparatus as claimed in claim 16 and including means for applying respective difference potentials to the said adjacent part, and an adjacent part of the waveguide wall adjacent the other side of the dielectric substrate.

18. Waveguide apparatus as claimed in claim 3, wherein two rows of slots are incorporated in the dielectric substrate assembled between the two sections of the waveguide, the conductive layer is a metallized layer and at least one of the metallized layers of the slots in each row forms an extension of the inner waveguide surface in the region of the dielectric substrate.

19. Waveguide apparatus as claimed in claim 18, wherein the row of slots corresponding to one side of the waveguide cavity are arranged so as to minimize power losses from the waveguide and those on the other are arranged such that they function as an antenna.

20. Waveguide apparatus as claimed in claim 18, wherein the metallized layer on the inside of each slot extends over part of the surface of the dielectric substrate to form a metal surface.

21. Waveguide apparatus as claimed in claim 20, wherein the metal surface extends into the waveguide cavity from each side of the dielectric substrate assembled between the two sections of the waveguide.

22. Waveguide apparatus as claimed in claim 21, further comprising electrical components and wherein the electrical components are connected between the two metal surfaces of the dielectric substrate extending into the waveguide cavity.

23. Waveguide apparatus as claimed in claim 22 wherein a plurality of said components control the phase of a signal as it is transmitted along the waveguide, the waveguide being operative as a phased array antenna.

24. Waveguide apparatus as claimed in claim 23, further comprising insulating material disposed between the dielectric substrate and an adjacent part of the waveguide wall and means for applying respective difference potentials to the said adjacent part, and an adjacent part of the waveguide wall adjacent to the side of the dielectric substrate.

25. Waveguide apparatus as claimed in claim 24 wherein several such waveguides are arranged to form a rectangular array antenna.

26. Waveguide apparatus as claimed in claim 25 including means for applying a signal to the waveguides in parallel.

27. A waveguide apparatus comprising:

a waveguide having an inner surface defining a rectangular cavity with a longitudinal axis and being formed of at least one section of walls, each said at least one section having two planar end surfaces and forming at least part of the rectangular cavity; and a dielectric substrate disposed between planar end surfaces of at least one wall of the waveguide, said substrate having at least one row of slots, each slot comprising a first elongate portion parallel to the longitudinal axis, and second and third elongate portions extending outwardly, in the same direction and at an angle, from respective ends of the first elongate portion; and a conductive layer disposed on its surface forming the slots and on a surface parallel to the planar end surfaces, wherein, in each at least one row of slots, the first elongated portions are substantially co-linear, and the conductive layer disposed on the parallel substrate surface surrounds each slot extending from a waveguide inner surface to a distance short of an outer waveguide surface.

28. A waveguide apparatus according to claim 27, wherein the second and third elongate portions extend at right angles from the respective ends of the first elongate portion and extend away from the center of the rectangular cavity.

29. A waveguide apparatus according to claim 27, wherein the second and third elongated portions extend away from the center of the rectangular cavity and are directed towards one another.

* * * * *